US009198468B2

(12) United States Patent
McNeeley et al.

(10) Patent No.: US 9,198,468 B2
(45) Date of Patent: Dec. 1, 2015

(54) SUPPORT COMPONENT FOR A BRA

(71) Applicant: Victoria's Secret Stores Brand Management, Inc., Reynoldsburg, OH (US)

(72) Inventors: Carolyn M. McNeeley, University Heights, OH (US); Patrick Brown, Auburn, OH (US); Nick Stanca, Westlake, OH (US)

(73) Assignee: Victoria's Secret Stores Brand Management, Inc., Reynoldsburg, OH (US)

( * ) Notice: Subject to any disclaimer, the term of this patent is extended or adjusted under 35 U.S.C. 154(b) by 374 days.

(21) Appl. No.: 13/767,377

(22) Filed: Feb. 14, 2013

(65) Prior Publication Data

US 2014/0227943 A1 Aug. 14, 2014

(51) Int. Cl.
*A41C 3/00* (2006.01)
*A41C 3/12* (2006.01)

(52) U.S. Cl.
CPC ..... *A41C 3/122* (2013.01); *A41C 3/0007* (2013.01)

(58) Field of Classification Search
CPC ..... A41C 1/14; A41C 1/16; A41C 3/0007; A41C 3/12; A41C 3/122; A41C 3/123; A41C 3/124; A41C 3/126; A41C 3/128
USPC ..... 2/39, 41, 45, 48, 51, 52
See application file for complete search history.

(56) References Cited

U.S. PATENT DOCUMENTS 3,562,802 A * 2/1971 Avis ..... 450/52
3,747,606 A * 7/1973 Tareau ..... 450/48
3,777,763 A * 12/1973 Schwartz ..... 450/52
4,646,746 A 3/1987 O'Boyle et al.
5,219,311 A * 6/1993 Fildan ..... 450/41
5,472,366 A * 12/1995 Moore ..... 450/41
5,730,640 A * 3/1998 Acx et al. ..... 450/41

(Continued)

FOREIGN PATENT DOCUMENTS

CN 201541731 U 8/2010
CN 102058167 A 5/2011

(Continued)

OTHER PUBLICATIONS

Invitation to Pay Additional Fees and Partial International Search Report for PCT/US2013/067807 dated Dec. 10, 2013.

(Continued)

*Primary Examiner* — Gloria Hale
(74) *Attorney, Agent, or Firm* — Andrus Intellectual Property Law, LLP

(57) ABSTRACT

A support component for attachment to a lower edge of a bra, having a generally U-shaped molded body defined in an x-direction, a y-direction perpendicular to the x-direction, and a z-direction perpendicular to both the x-direction and the y-direction, the body being bisected in part by an x-y plane, a lower curved portion of the body extending generally in the x-direction within the x-y plane, a first upper side portion of the body extending from a first end of the lower curved portion in both the y-direction and the z-direction and fully crossing to a first side of the x-y plane, and a second upper side portion of the body extending from a second, opposite end of the lower curved portion in both the y-direction and the z-direction and fully crossing to a second, opposite side of the x-y plane.

20 Claims, 8 Drawing Sheets

(56) References Cited

U.S. PATENT DOCUMENTS

| | | | | |
|---|---|---|---|---|
| 6,106,363 | A | 8/2000 | Werner | |
| 6,206,753 | B1 | 3/2001 | Werner | |
| 6,241,576 | B1 | 6/2001 | Höfer | |
| 6,346,028 | B1 | 2/2002 | Fildan et al. | |
| 6,447,365 | B1 | 9/2002 | Powell et al. | |
| 6,857,933 | B2 * | 2/2005 | Horta et al. | 450/41 |
| 6,966,815 | B2 * | 11/2005 | Weinerth | 450/41 |
| 7,112,117 | B2 * | 9/2006 | Horta et al. | 450/41 |
| 7,390,239 | B1 * | 6/2008 | Huang | 450/39 |
| 7,407,428 | B2 * | 8/2008 | Fildan et al. | 450/41 |
| 7,677,950 | B2 | 3/2010 | Mutschler | |
| 7,824,242 | B2 | 11/2010 | Perman et al. | |
| 7,841,924 | B2 | 11/2010 | Wan | |
| 8,087,972 | B2 | 1/2012 | Mutschler | |
| 2005/0124261 | A1 | 6/2005 | Martini | |
| 2009/0017724 | A1 | 1/2009 | Gill | |

FOREIGN PATENT DOCUMENTS

| | | |
|---|---|---|
| EP | 2324723 | 5/2011 |
| EP | 2471393 | 7/2012 |
| FR | 1512623 | 2/1968 |
| WO | 2005092130 | 10/2005 |
| WO | 2013056302 | 4/2013 |
| WO | 2013056302 A1 | 4/2013 |

OTHER PUBLICATIONS

International Search Report and Written Opinion for PCT/US2013/067807 dated Jan. 9, 2014.

* cited by examiner

SUPPORT COMPONENT FOR A BRA

FIELD

The present disclosure relates to support components for attachment to the lower edges of a bra, such as for example an underwire.

BACKGROUND

Bras are often provided with support components, such as one or more underwires that are attached along the lower edge of each bra cup to provide support to a wearer's breasts. Such support components can be inserted within a tunnel casing along a lower edge of the bra cup, can be sewn directly to the lower edge of the bra cup and provided with a cover fabric, can be adhered to the lower edge of the bra cup, or can be attached in any number of different ways to the bra cup. Often, if the support component is made of a hard material, the support component is uncomfortable for the wearer of the bra. For instance, the ends of the support component may poke out from the bra cup and into the wearer's skin.

Further, rigid support components do not bend easily as the wearer of the bra moves. If the support component does bend as the wearer moves, it may be subject to breakage.

SUMMARY

One aspect of the present application includes a support component for attachment to a lower edge of a bra. The support component comprises a generally U-shaped molded body defined in an x-direction, a y-direction perpendicular to the x-direction and a z-direction perpendicular to the both the x-direction and the y-direction. The body is bisected in part by an x-y plane. A lower curved portion of the body extends generally in the x-direction within the x-y plane. A first upper side portion of the body extends from a first end of the lower curved portion in both the y-direction and the z-direction and fully crosses to a first side of the x-y plane. A second upper side portion of the body extends from a second, opposite end of the lower curved portion in both the y-direction and the z-direction and fully crosses to a second, opposite side of the x-y plane.

In another aspect of the present application, a support component for attachment to a lower edge of a bra comprises a molded polymer body extending in a generally U-shaped curve and having a cross-sectional shape that continuously varies along the length of the curve. A first end of the body has an oblong cross-section. An intermediate lower curved portion of the body has a curved cross-section. A second end of the body has an oblong cross-section. The first and second ends of the body are twisted with respect to the lower curved portion such that major axes of the oblong cross-sections at the first and second ends are angled with respect to a major axis of the angled cross-section.

In another aspect of the present application, a bra having at least one support component attached to a lower edge of the bra is disclosed. The at least one support component comprises a generally U-shaped molded body defined in an x-direction, a y-direction perpendicular to the x-direction and a z-direction perpendicular to the both the x-direction and the y-direction. The body is bisected in part by an x-y plane. A lower curved portion of the body extends generally in the x-direction within the x-y plane. A first upper side portion of the body extends from a first end of the lower curved portion in both the y-direction and the z-direction and fully crosses to a first side of the x-y plane. A second upper side portion of the body extends from a second, opposite end of the lower curved portion in both the y-direction and the z-direction and fully crosses to a second, opposite side of the x-y plane.

BRIEF DESCRIPTION OF THE DRAWINGS

Examples of a support component for attachment to a lower edge of a bra are described with reference to the following Figures. These same numbers are used throughout the Figures to reference like features and like components.

DETAILED DESCRIPTION OF DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different articles described herein may be used alone or in combination with other articles. Various equivalents, alternatives, and modifications are possible within the scope of the appended claims. Each limitation in the appended claims is intended to invoke interpretation under 35 USC §12, sixth paragraph, only if the terms "means for" or "step for" are explicitly recited in the respective limitation.

Figures 1, 1A, 1B, 1C:
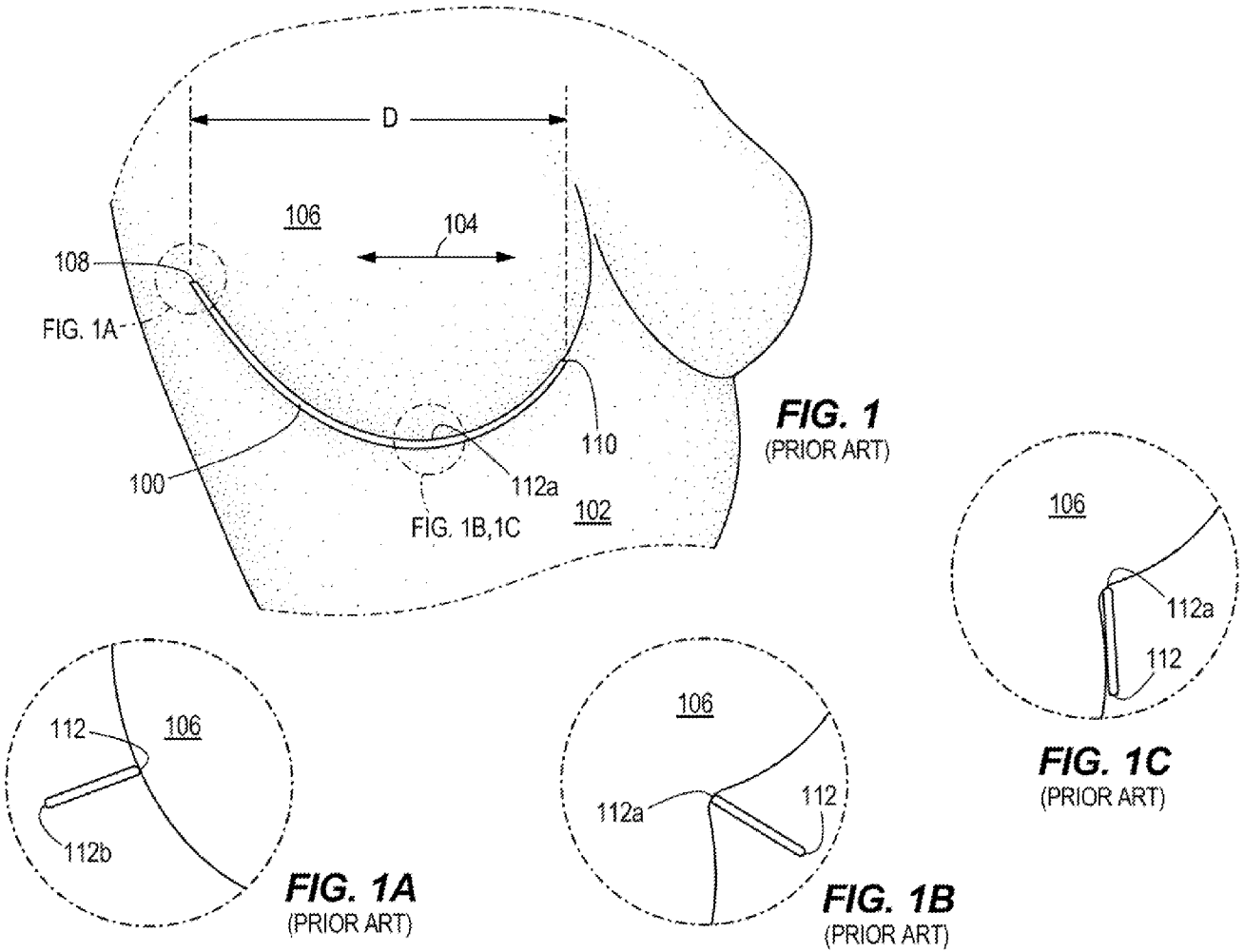
FIG. 1 (PRIOR ART)
FIG. 1A (PRIOR ART)
FIG. 1B (PRIOR ART)
FIG. 1C (PRIOR ART)
FIGS. 1, 1A, 1B, and 1C show a prior an underwire.

FIG. 1 illustrates a prior art underwire 100 on the chest 102 of a wearer. The underwire 100 is a typical metal underwire and is defined primarily in two dimensional form. The underwire 100 is typically sewn into a pocket in a bra. As the bra is stretched or wrapped around the wearer's chest 102 the underwire 100 bends slightly in the direction of arrow 104 in order to wrap around the wearer's chest 102. In order to provide support to a wearer's breast 106, the underwire 100 is designed to be structurally rigid enough to maintain a lateral distance D between both of its ends 108, 110. Without being able to maintain this lateral distance D, the breast 106 will lack projection. However, the structural rigidity provided by a metal underwire 100 is problematic for several reasons.

First, a metal underwire 100 is susceptible to breakage while in use and can possibly injure the wearer. Additionally, if the metal underwire 100 is severely bent out of shape, it will most likely be permanently deformed. Metal is also limited in its ability to comfortably and successfully wrap around the chest 102 of a wearer. The pocket in the bra in which the underwire 100 is inserted forces the underwire 100 to bend around the wearer's chest 102. The underwire itself does not twist and is mostly capable of bending only in a front to back or back to front direction. This lack of flexibility in a metal underwire 100 creates a great deal of force and pull on the fabric of the bra, which could cause holes in the material of the bra and poking or scratching of the wearer.

Additionally, because a metal underwire 100 is limited in its bending capabilities, the edges 112 (shown in FIGS. 1A and 1B) are often bent such that they are perpendicular to the skin on the surface of the wearer's chest 102 or breast 106. For example, as shown in FIG. 1A, due to material and shape limitations in the design of the underwire 100 as it wraps around the chest 102, one edge 112*b* of the underwire 100 lifts away from the body on the side under the arm and creates an area of discomfort for the wearer. As another example, in FIG. 1B, the underwire 100 lifts away from the wearer's chest 102 under the wearer's breast 106 and creates another area of discomfort for the wearer at edge 112*a*.

Finally, as another example shown in FIG. 1C, even when the underwire 100 is not stressed as it wraps around the wearer's chest 102, the underwire 100 is designed to rest under the wearer's breast 106 in order to provide support to the breast 106. The underwire 100 rests on the chest 102 of the wearer and the breast 106 rests solely on the narrow top edge 112*a* of the underwire 100. This also causes discomfort for the wearer.

Figure 2:
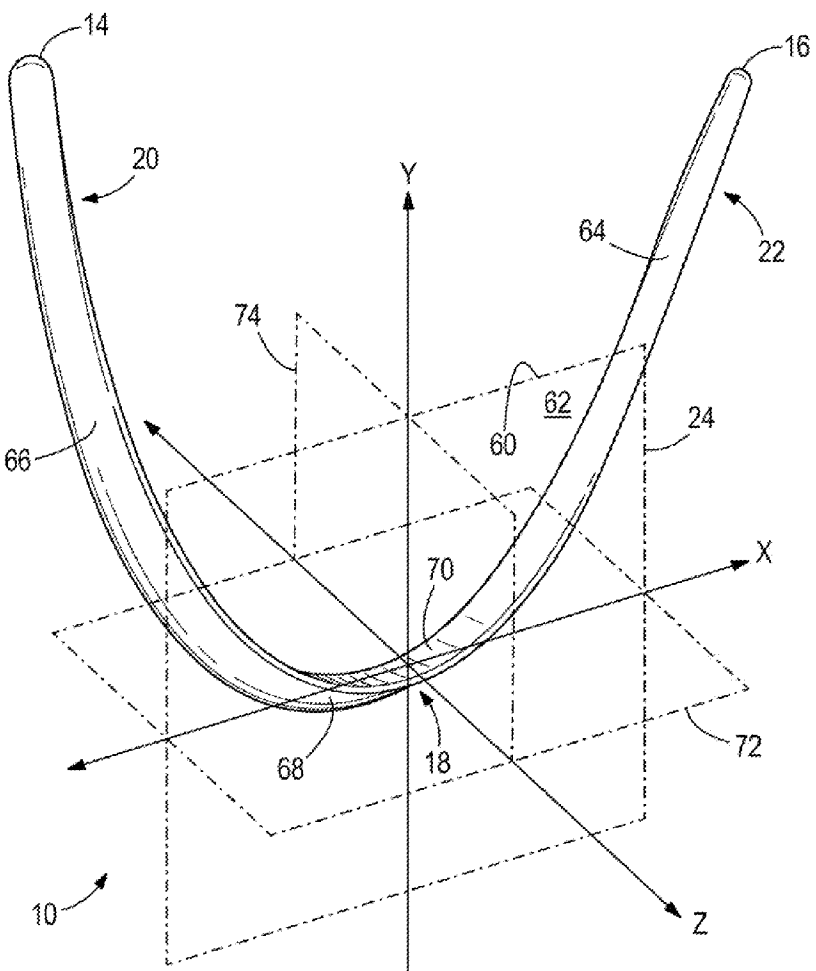
FIG. 2 shows a perspective view of a support component according to the present application.

In contrast to the prior art underwire 100 shown in FIGS. 1, 1A, 1B, and 1C, the support component 10 of the present disclosure comfortably wraps around wearer's chest 102 and at the same time successfully supports the breast 106. The support component 10 as shown in FIG. 2 comprises a generally U-shaped molded body 12 (see FIG. 4) defined in a x-direction, a y-direction perpendicular to the x-direction, and a z-direction perpendicular to both the x-direction and the y-direction. The support component 10 has a first end 14 and a second end 16. A lower curved portion 18 comprises an intermediate portion of the body 12. Between the first end 14 and the lower curved portion 18, the support component 10 comprises a first upper side portion 20. Between the second end 16 and the lower curved portion 18, the support component 10 comprises a second upper side portion 22.

As shown in FIG. 2, the body 12 is bisected in part by an x-y plane 24 that extends in the x-direction and the y-direction. The lower curved portion 18 of the body 12 extends generally in the x-direction within the x-y plane 24. This can also be seen in FIG. 3, where the lower curved portion 18 extends along the x-y plane 24, of which only the x-direction is visible in FIG. 3.

Figure 4:
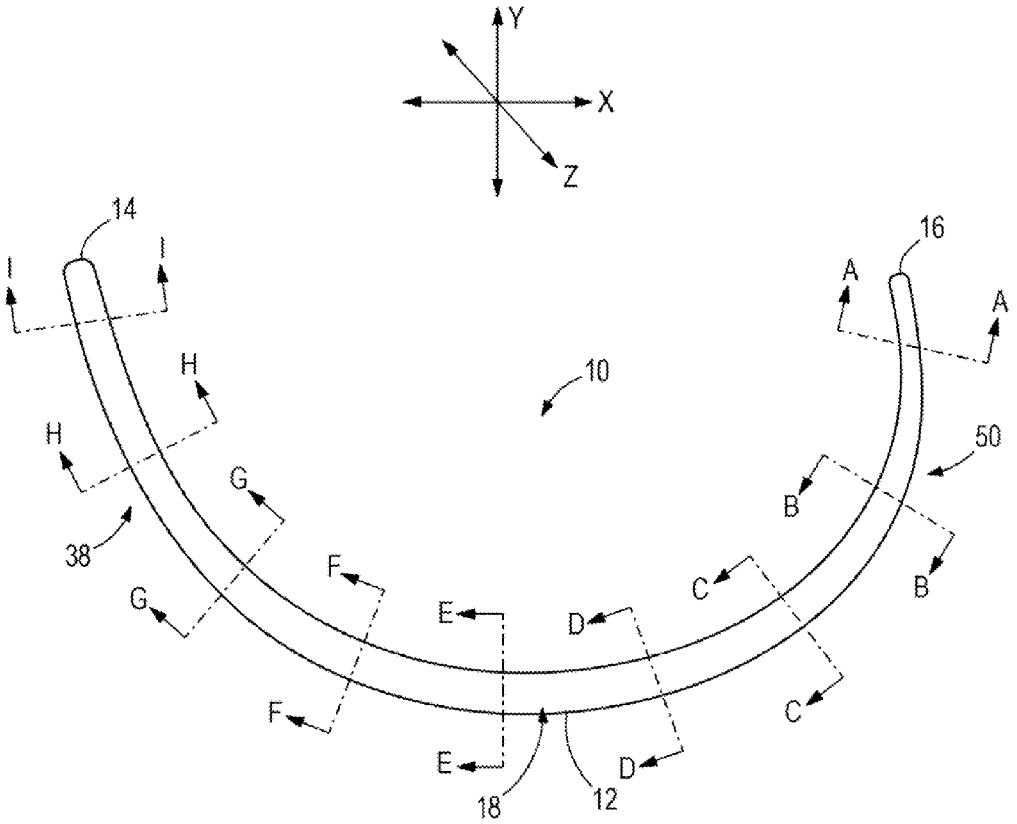
FIG. 4 shows a front view of the support component.

Now with reference to FIG. 4, the cross-sectional shape of the body 12 will be more fully described. As described herein above, the support component 10 comprises a molded polymer body 12 that extends in a generally U-shaped curve and has a cross-sectional shape that continuously varies along the length of the curve, as can be seen from FIGS. 5-13. The first end 14 of the body 12 has an oblong cross-section 26 at I-I, as shown in FIG. 13. The oblong cross-section has a major axis 28. The oblong cross-section 26 also has rounded corners 30. However, the corners of the oblong cross-section 26 need not be rounded and could instead be sharp, thereby forming a rectangle. The oblong cross-section could alternatively, for example, have an elliptical shape rather than the rounded rectangular shape shown.

Figure 12:
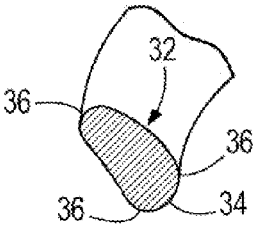
Figure 13:
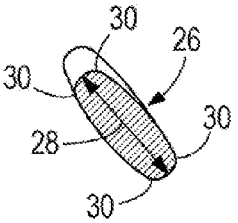

Now with reference to FIG. 12, at cross-section H-H, one end of the oblong cross-section 26 widens out in comparison to cross-section I-I such that the body 12 has a generally triangular cross-section 32. This portion of the body 12 comprises a first transition portion 38 between the first end 14 and the lower curved portion 18. At the first transition portion 38, a base 34 of the triangular cross-section 32 faces toward a back of the wearer when the bra is in use, thereby providing both comfort and structural support to the wearer's breast 106. The triangular cross-section 32 has rounded corners 36; however, it should be understood that the triangular cross-section 32 could also have sharp corners.

Figure 10:
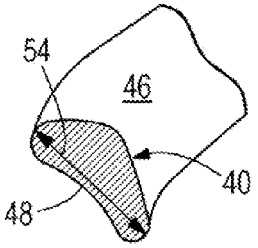
Figure 11:
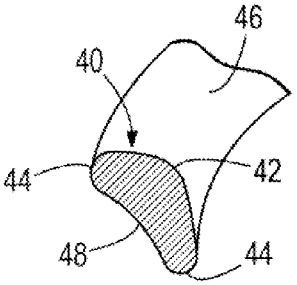
Figure 16A:
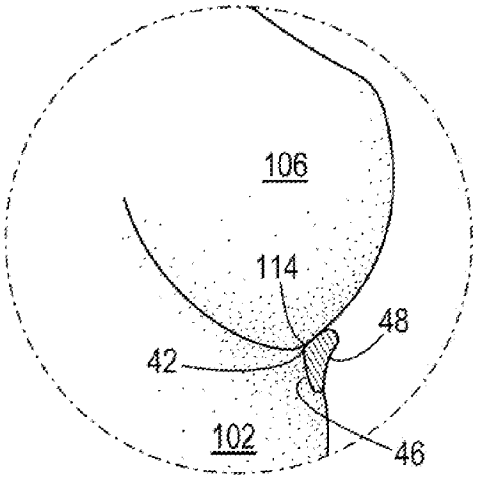
FIGS. 16, 16A, 17, and 17A show the support component as placed on the chest of a wearer.
Figure 17:
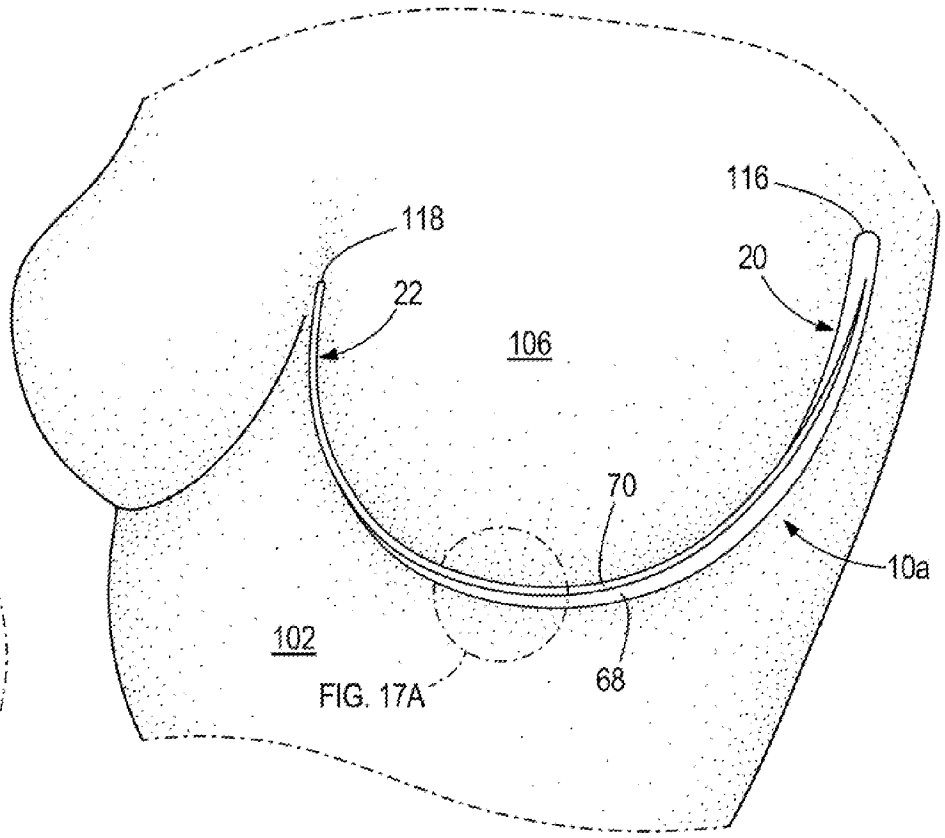
Figure 17A:
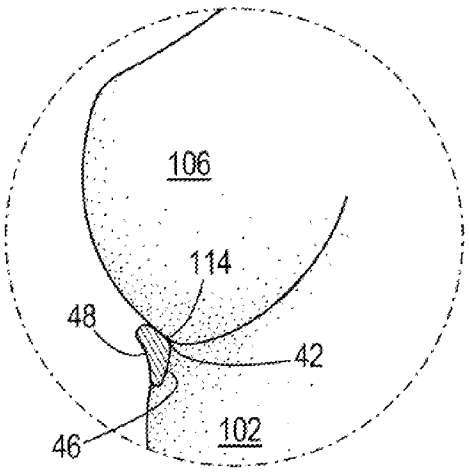

Now with reference to FIGS. 4 and 11 (cross-section G-G), at lower curved portion 18, the body 12 has a curved cross-section 40. The curved cross-section 40 has an exaggerated apex 42 and rounded horns 44. The curved cross-section 40 has a major axis 54, as shown in FIG. 10 (cross-section F-F). The curved cross-section 40 also has a convex surface 46 and a concave surface 48. As can be seen from FIGS. 7-11, the curved cross-section 40 continues along the length of the lower curved portion 18. Further, the curved cross-section 40 of the body 12 can vary continuously in its width W and/or thickness T (see FIG. 7, cross-section C-C). The curvature of the horns 44 and the apex 42 may also vary. Additionally, the horns 44 and apex 42 need not be rounded, but could be sharp. The convex surface 46 could be more Of less convex, and the concave surface 48 could be more or less concave than as illustrated in FIGS. 7-11 in the examples shown, the curved cross-section 40 comprises a somewhat triangular crescent shape, but could comprise various other curved shapes and still fall within the scope of the present application. The cross-sectional shape of the body 12 at the intermediate portion 18 ensures that the support component 10 conforms to the wearer's chest 102 and breast 106. As shown in FIGS. 16A and 17A, the body 12 rests on a wearer's chest 102 such that the convex surface 46 of the curved cross-section 40 lies adjacent the wearer's chest 102. Additionally, as shown in FIGS. 16A and 17A, the apex 42 of the curved cross-section 40 lies in a crevice 114 where an underside of the wearer's breast 106 meets the wearer's chest 102.

Figure 5:
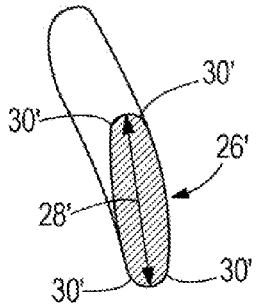
FIGS. 5-13 show cross-sectional views taken along the lines shown in FIG. 4.
Figure 6:
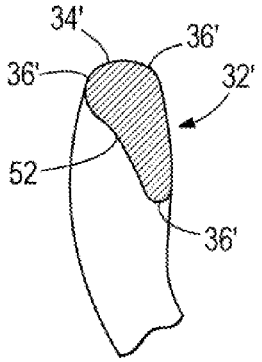

Now with reference to FIGS. 4 and 6 (cross-section B-B), a second transition portion 50 between the lower curved portion 18 and the second end 16 of the body 12 also comprises a triangular cross-section 32 similar to that shown in FIG. 12. The triangular cross-section 32' has a base 34' that faces toward a back of the wearer. The triangular cross-section 32' also has rounded corners 36. Because this portion of the body 12 comprises a second transition portion 50 between the curved cross-section 40 and an oblong cross-section 26' at the second end 16 (see FIG. 5), the triangular cross-section 3T may comprise a slight concavity, as shown at 52. This concavity 52 fills in as the second end 16 of the body 12 is approached.

With reference to FIGS. 4 and 5 (cross-section A-A), the second transition portion 50 transitions into the second end 16 of the body 12, where the body 12 has an oblong cross-section 26. As with the oblong cross-section 26 at the first end 14 of the body 12 (shown in FIG. 13) the oblong cross-section 26 of FIG. 5 has rounded corners 30. The oblong cross-section 26' also has a major axis 28'.

Now with reference to each of FIGS. 4-13, it can be seen that the cross-sectional shape of the body 12 continuously varies along the length of the body 12. For instance, at the first end 14, the body has an oblong cross-section 26 (FIG. 13). One end of this oblong cross-section 26 widens out as the first transition portion 38 is approached, such that at the first transition portion 38, the body 12 has a triangular cross-section 32 where the widened portion of the oblong cross-section 26 has become the base 34 of the triangular cross-section 32. Further continuing along the length of the body 12, as the lower curved portion 18 is approached, the body 12 takes on a curved cross-section 40 (see FIGS. 7-11) having a convex surface 46 and a concave surface 48. Continuing along the body 12, at the second transition portion 50, the body 12 once again takes on a triangular cross-section 32' as the apex 42 of the curved cross-section 40 melds into the base 34' of the triangular cross-section 32'. The base 34' of the triangular cross-section 32' then narrows such that the body 12 takes on an oblong cross-section 26' at the second end 16 as shown in FIG. 5.

Figure 7:
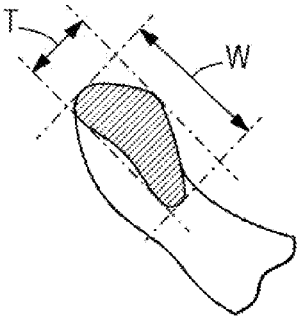
Figure 8:
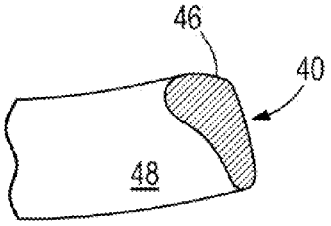
Figure 9:
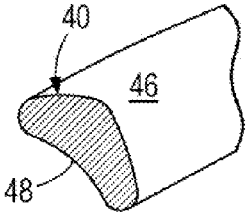
Figure 15:
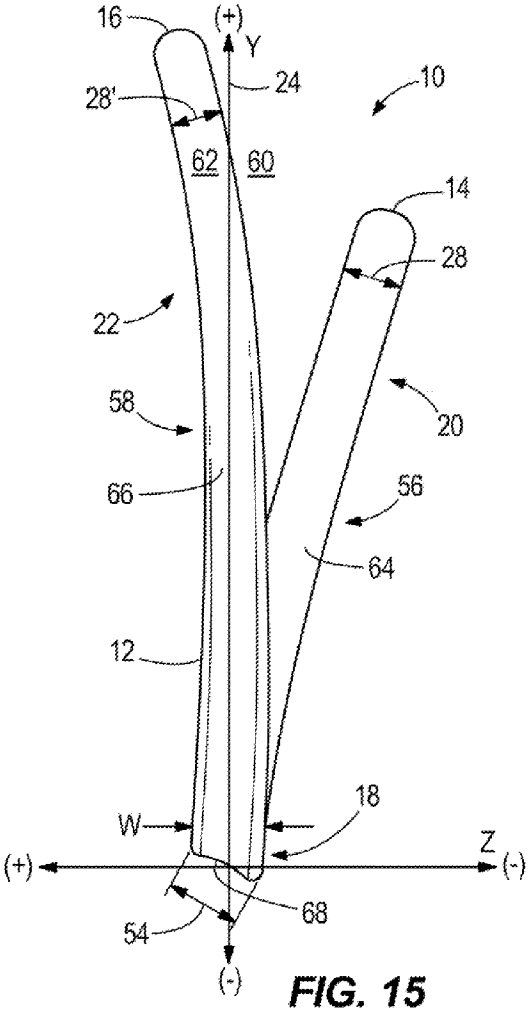
FIG. 15 shows a right side view of the support component.
Figure 14:
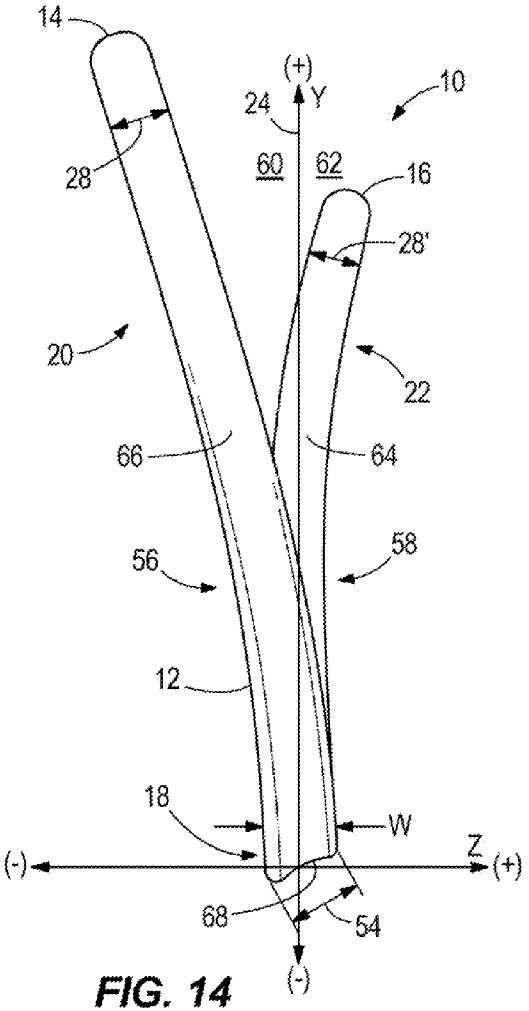
FIG. 14 shows a left side view of the support component.

Now with reference to FIGS. 14 and 15, the three dimensional nature of the support component 10 will be more fully described. As discussed with reference to FIGS. 1 and 2, the body 12 is bisected in part by the x-y plane 24, which is visible only along the y-direction in FIGS. 14 and 15. The body 12 has a width W in the z-direction (see also FIG. 7). As shown in FIGS. 7, 14, and 15, the width W extends to either side of the x-y plane 24 (i.e., the x-y plane 24 bisects the body 12) although it should be understood that the x-, y-, and z-directions need not have the same point of origin as that shown in these Figures.

Figure 3:
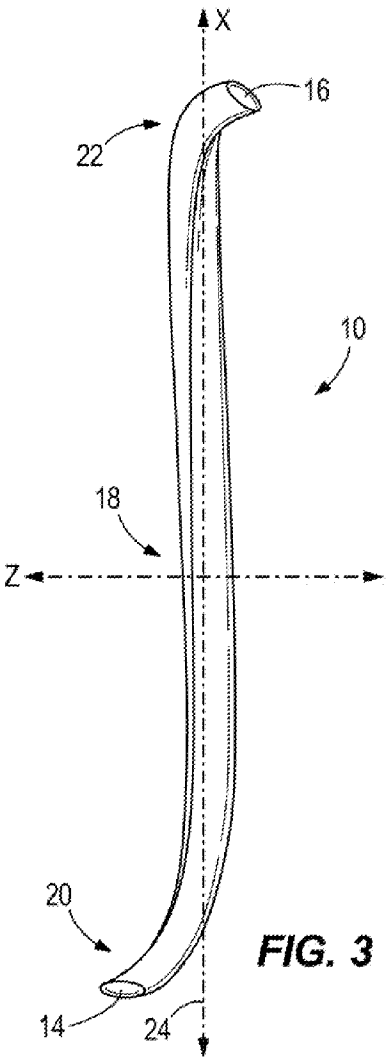
FIG. 3 shows a top view of the support component of FIG. 2.

As described hereinabove, the lower curved portion 18 of the body 12 extends generally in the x-direction within the x-y plane 24 (see FIGS. 2 and 3). With reference back to FIGS. 14 and 15, from the lower curved portion 18, the first upper side portion 20 of the body 12 extends in a negative z-direction toward a back of the wearer and the second upper side portion 22 of the body 12 extends in a positive z-direction toward a front of the wearer. The first upper side portion 20 extends from a first end 56 of the lower curved portion 18. The first upper side portion 20 extends in both the y-direction and the z-direction. In this example, the first upper side portion 20 of the body 12 extends in the positive y-direction and in the negative z-direction. The first upper side portion 20 continues to extend in both the y-direction and the z-direction until it fully crosses to a first side 60 of the x-y plane 24 (see FIG. 2). The first upper side portion 20 continues to extend in both the y-direction and the z-direction until it reaches the first end 14.

Similarly, the second upper side portion 22 extends from a second end 58 of the lower curved portion 18. The second upper side portion 22 extends in both the y-direction and the z-direction. In the example shown, the second upper side portion 22 extends in the positive y-direction and the positive z-direction. The second upper side portion 22 continues to extend in the y-direction and the z-direction until it fully crosses to a second side 62 of the x-y plane 24. The second upper side portion 22 continues to extend until it reaches the second end 16 of the body 12. The lower curved portion 18 therefore extends within the x-y plane 24 until it reaches the first and second ends 56, 58 of the lower curved portion 18, where the body 12 then splays to either side of the x-y plane 24.

With continued reference to FIGS. 14 and 15, the body 12 has a first surface 64 that faces toward a wearer's skin when the bra is in use. The body 12 has a second, opposite surface 66 that faces away from the wearer's skin. The first surface 64 corresponds to the convex surface 46 of the curved cross-section 40 as shown in FIGS. 7-11. The first surface 64 however also continues along the entire length of the body 12 such that it continues to face toward the wearer's skin even at the first upper side portion 20 and the second upper side portion 22. As described with reference to FIGS. 7-11, at the lower curved portion 18, the first surface 64 is convex and corresponds to the convex surface 46, and the second surface 66 is concave and corresponds to the concave surface 48.

Figure 16:
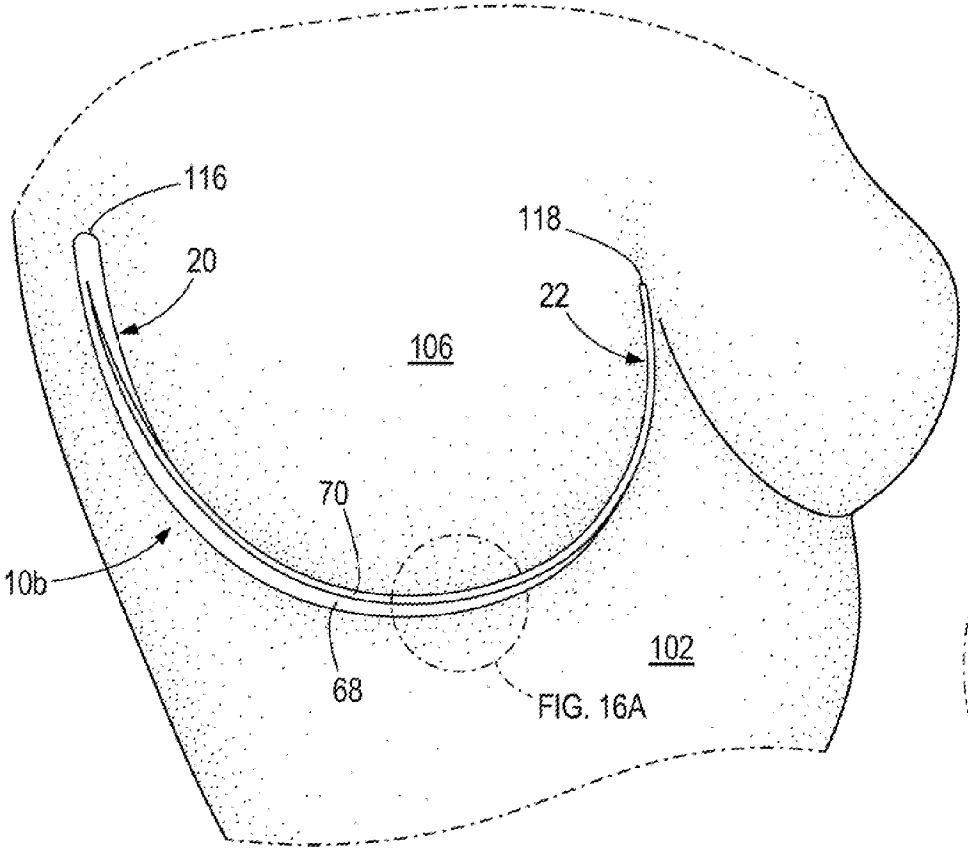

With reference to FIGS. 2, 14, and 15, at the lower curved portion 18, the second surface 66 extends out of the x-y plane 24 in a gentle curve 68 from the y-direction into the z-direction. As shown in those FIGS. 2, 14, and 15, the curve 68 is angled with respect to both the x-y plane 24 and an x-z plane 72 that is defined in the x-direction and the z-direction. The curve 68 is a portion of the concave surface 48 (FIGS. 7-11). Also at the lower curved portion 18, the first surface 64 forms a shelf 70 (see FIG. 2) that extends in the z-direction. The shelf 70 supports an underside of the wearer's breast 106, as shown in FIGS. 16 and 17. The shelf 70 is a portion of the convex surface 46. The combination of the curve 68 and the shelf 70 provides the support component 10 with both support for the wearer's breast 106 due to the shelf 70 and flexibility due to the thickness T of the body 12 (see FIG. 7) not being very great in the lower curved portion 18.

With reference to FIGS. 16 and 17, the first upper side portion 20 lies near an outer edge 116 of the wearer's breast 106. The second upper side portion 22 lies near an inner edge 118 of the wearer's breast 106. From examination of FIGS. 16 and 17, it can be seen that the support component 10 for a wearer's left breast is a mirror image to that of the support component 10 for the wearer's right breast. In other words, in one example, the same support component 10 cannot be used for both a wearer's left breast and right breast, as can be done with conventional underwires 100 (see FIG. 1). Rather, the support component 10 is designed such that there is a dedicated right breast support component **10*b* and a dedicated left breast support component 10*a* that are mirror images of one another. The difference between the right and left support components 10*b*, 10*a* reflects the need to conform the exact 3-dimensional shape and cross-sectional shape of the support component 10 to the wearer's breasts 106 and chest 102 in order to provide comfort and flexibility and to decrease the need to bend or stress the support component 10** to fit the wearer's body.

Not only does the body 12 splay to first and second sides 60, 62 of the x-y plane 24, the body 12 also twists out of being parallel to the x-y plane 24 as will be described further with reference to FIGS. 2, 3, 14, and 15. As can be seen from FIG. 3, the body 12 has a gently curved S-shape when projected onto the x-z plane 72 that is defined in the x-direction and the z-direction. As can be seen from FIGS. 2, 3, 14, and 15, the body 12 is parallel to the x-y plane 24 at the lower curved portion 18 and gradually twists out of being parallel to the x-y plane 24 such that the first upper side portion 20 and the second upper side portion 22 are parallel to a y-z plane 74 that is defined in the y-direction and the z-direction. In other words, the first and second ends 14, 16 of the body 12 are twisted with respect to the lower curved portion 18 such that the major axes 28, 28' of the oblong cross-sections 26, 26' at the first and second ends 14, 16 are angled with respect to the major axis 54 of the curved cross-section 40. In one example, the major axes 28, 28' of the oblong cross-sections 26, 26' at the first and second ends 14, 16 are angled at 90 degrees with respect to the major axis 54 of the curved cross-section 40. In another example, the major axes 28, 28' are angled at 45 degrees with respect to the major axis 54. It is to be understood that the angle at which the first and second ends 14, 16 are twisted with respect to the lower curved portion 18 can vary according to the desired fit around a wearer's breast 106. Further, the first and second ends 14, 16 can be twisted such that the major axis 28 at the first end 14 is angled at a different angle with respect to the major axis 54 than is the major axis 28' at the second end 16 with respect to the major axis 54.

In general, the body 12 is twisted such that the major axes 28, 28' at the first and second ends 14, 16 and the major axis 54 at the lower curved portion follow the curve of the wearer's breast 106. For example, the major axis 28 of the oblong cross-section 26 at the first end 14 lies parallel to an outer edge 116 of a wearer's breast 106 and the major axis 28' of the oblong cross-section 26' at the second end 16 lies parallel to an inner edge 118 of the wearer's breast. Where greater support is required, such as on the underside of the wearer's breast 106, the first surface 64 that is adjacent the wearer's chest 102 is convex and the second surface 66 is concave, thereby providing both support and flexibility to the body 12 as described herein above. Near the first and second upper side portions 20, 22, both the first surface 64 and the second surface 66 can be convex, such as would be the case if the oblong cross-sections 26, 26' were elliptical, because not as much material is needed at the these portions 20, 22 to provide support to the wearer's breast 106. Decreasing the thickness T at the first and second upper side portions 20, 22 also provides flexibility to these portions 20, 22 as the wearer moves. In another example, the first and second surfaces 64, 66 are planar, such as would be the case if the oblong cross-sections 26, 26' were rectangular.

The support component 10 of the present disclosure comprises a molded polymer-based material. In one example, the body 12 comprises a polymer blend. Because the support component 10 is pre-contoured to a wearer's chest 102, movement of the support component 10 does not require the fabric of a bra into which it is inserted to pull and thereby deform the support component 10 into a desired shape. Because the support component is under less tension, there is less stress placed on the bra materials and/or underwire pocket. Contouring of the body 12 to extend in both a negative z-direction toward a back of the wearer at the first upper side portion 20 adjacent an outer edge 116 of a wearer's breast 106, and to extend in a positive z-direction at the second upper side portion 22 near an inner edge 118 of a wearer's breast 106 eliminates the need for deformation or movement of the body 12 away from the wearer's chest 102. Ideally, the wearer will move freely while wearing the bra and the body 12 will comfortably move with her as opposed to being pulled away from the wearer's chest 102 in certain areas.

Further, the cross-section of the body 12 as shown in FIGS. 5-13 provides both strength and flexibility along the length of the body 12. The cross-section is also specifically designed to limit exposed ends 108, 110 and possible uncomfortable areas at edges 112. The cross-section at the lower curved portion 18 contours to both the wearer's chest 102 and the base of the breast 106, specifically at the crevice 114. The first and second ends 14, 16 of the body 12 are designed to contour to the outer and inner edges 116, 118 of the wearer's breast 106. The body 12 is designed to rest on the wearer's chest 102 and rise up under the base of the breast 106 into the crevice 114, as was described herein above with regards to the gentle curve 68 and the shelf 70 provided by the first and second surfaces 64, 66 of the body 12. The result is a comfortable, seamless and supportive support component 10.

Figure 18:
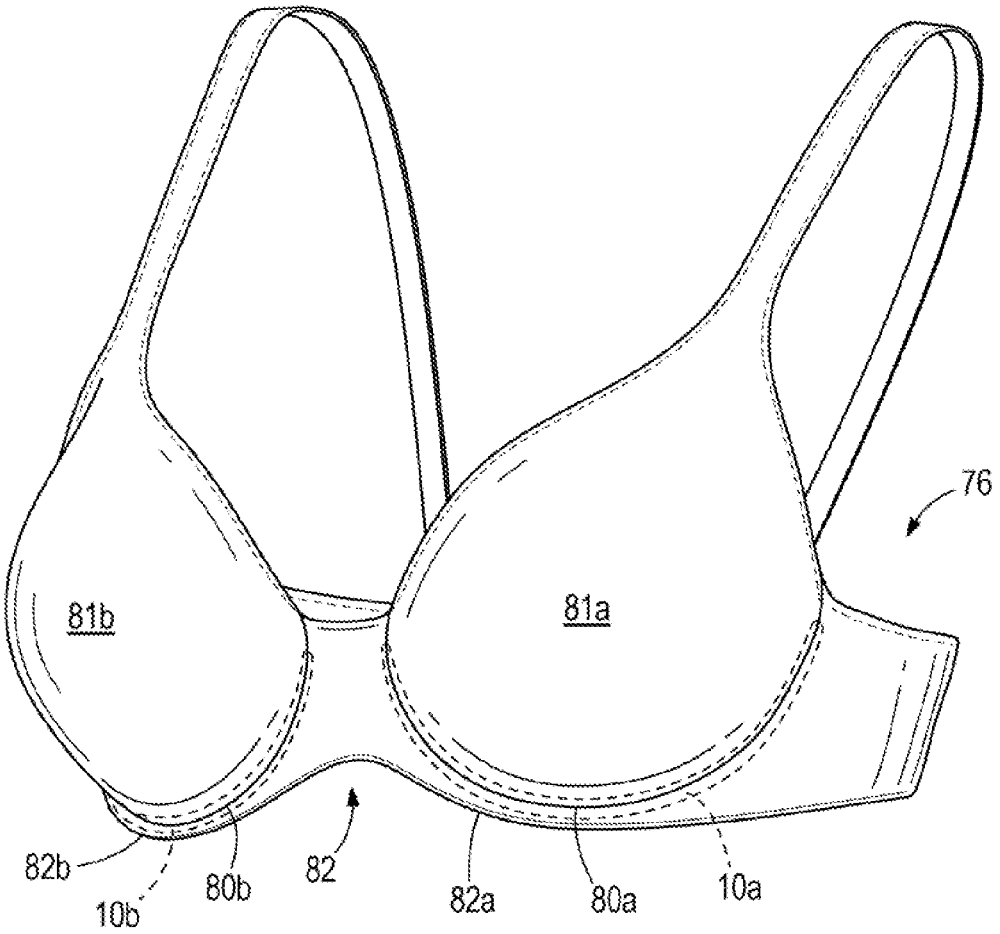
FIG. 18 shows a bra incorporating the support component of the present application.

The support component 10 of the present disclosure may attached to the lower edge 82 of a bra 76, as shown in FIG. 18, and may work on several different breast types and/or breast sizes that currently share the same underwire size. The bra 76 comprises a first support component 10*a* attached to a lower edge 82*a* of a left bra cup 81*a* and a second support component 10*b* attached to a lower edge 82*b* of a right bra cup 81*b*, wherein the first support component 10*a* is a mirror image of the second support component 10*b*. In order to form the support component 10 of the present disclosure, solid resin pellets are liquefied and injected into a mold cavity having the dimensions of the body 12 as described herein above. The body 12 is then molded according to known processes and the overflow is trimmed from the body 12 once cooled. In one example, the polymer blend is consistent throughout the length of the body 12. Therefore, changes in flexibility of the body 12 along its length are due to the cross-sectional shape and twisting of the body 12. In other examples, the body 12 could be molded or processed post-molding to create sewing holes or thin areas that allow the body 12 to be sewn into place with the bra 76. It is also possible that the support component 10 could be applied onto the bra 76 rather than into pockets 80*a*, 80*b* in the lower edges 82*a*, 82*b*. This could be done by adhesive, heat processing, or additional sewing.

When compared to the underwire 100 of FIGS. 1, 1A, 1B, and 1C, the support component 10 of the present disclosure provides improved comfort due to its specific three-dimensional and cross-sectional shape as described herein above. Further, the support component 10 of the present disclosure is light weight due to it being made of a polymer-based material. The shape and material of the support component ensure that it conforms to the wearer's body, provides comfort all day long, and eliminates poke through associated with metal underwires. The resiliency of the polymer-based material ensures that the support component 10 maintains a desired shape for the life of the bra 76. Further, a bra 76 incorporating the support component 10 is machine washable.

In the above description certain terms have been used for brevity, clearness and understanding. No unnecessary limitations are to be implied therefrom beyond the requirement of the prior art because such terms are used for descriptive purposes only and are intended to be broadly construed. The different articles described herein above may be used in alone or in combination with other articles. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation.

What is claimed is:

1. A support component for attachment to a lower edge of a bra, the support component comprising:

a generally U-shaped molded body defined in an x-direction, a y-direction perpendicular to the x-direction, and a z-direction perpendicular to both the x-direction and the y-direction, the body being bisected in part by an x-y plane;

a lower curved portion of the body extending generally in the x-direction within the x-y plane and being bisected by the x-y plane;

a first upper side portion of the body extending from a first end of the lower curved portion in both the y-direction and the z-direction and fully crossing, to a first side of the x-y plane; and a second upper side portion of the body extending from a second, opposite end of the lower curved portion in both the y-direction and the z-direction and fully crossing to a second; opposite side of the x-y plane.

2. The support component of claim 1, wherein the body has a tint surface that faces toward a wearer's skin when the bra is in use and a second, opposite surface that faces away from the wearer's skin, and wherein at the lower curved portion the first surface is convex and the second surface is concave.

3. The support component of claim 2, wherein at the lower curved portion the second surface of the body extends out of the x-y plane in a gentle curve from the y-direction into the z-direction.

4. The support component of claim 3, wherein at the lower curved portion the first surface forms a shelf that extends in the z-direction and supports an underside of the wearer's breast.

5. The support component of claim 4, wherein the first upper side portion of the body extends in a negative z-direction toward a back of the wearer and the second upper side portion extends in a positive z-direction toward a front of the wearer.

6. The support component of claim 5, wherein the first upper side portion lies near an outer edge of the wearer's breast and the second upper side portion lies near an inner edge of the wearer's breast.

7. The support component of claim 2, wherein at the first and second upper side portions, the first surface is convex and the second surface is convex.

8. The support component of claim 1, wherein the body has a gently curved S-shape when projected onto an x-z plane that is defined, in the x-direction and the z-direction.

9. The support component of claim 1, wherein the body is parallel to the x-y plane at the lower curved portion, and gradually twists out of being parallel to the x-y plane such that the first and second upper side portions are parallel to a y-z plane that is defined in the y-direction and the z-direction.

10. The support component of claim 1, wherein the body comprises a polymer blend.

11. A support component for attachment to a lower edge of a bra, the support component comprising:

a molded polymer body extending in a generally U-shaped curve and having, a cross-sectional shape that continuously varies along the length of the curve;

a first end of the body having, an oblong cross-section;

an intermediate lower curved portion, of the body having a curved cross-section; and a second end of the body having an oblong cross-section, wherein the first and second ends of the body are twisted with respect to the lower curved portion such that major axes of the oblong cross-sections at the first and second ends are angled with respect to a major axis of the curved cross-section; and wherein the lower curved portion lies along and is bisected by a plane, the first end of the both crosses fully to one side of the plane, and the second end of the body crosses fully to an opposite side of the plane.

12. The support component of claim 11, wherein at a first transition portion of the body between the first end and the lower curved portion and at a second transition portion of the body between the lower curved portion and the second end, the hod has a generally triangular cross-section.

13. The support component of claim 12, wherein the major axes of the oblong cross-sections at the first and second ends are angled at 90 degrees with respect to the major axis of the curved cross-section.

14. The support component of claim 13, wherein when the bra is in use, the major axis of the oblong cross-section at the first end lies parallel to an outer edge of a wearer's breast and the major axis of the oblong cross-section at the second end lies parallel to an inner edge of the wearer's breast.

15. The support component of claim 11, wherein when the bra is in use a convex surface of the curved cross-section at the lower curved portion lies adjacent a wearer's chest and an apex of the curved cross-section lies in a crevice where an underside of the wearer's breast meets the wearer's chest.

16. The support component of claim 11, wherein the oblong cross-sections at the first and second ends have rounded corners and the curved cross-section at the lower curved portion has an exaggerated apex and rounded horns.

17. The support component of claim 16, wherein the carved cross-section comprises a triangular crescent shape.

18. A bra having at least one support component attached to a lower edge of the bra, the at least one support component comprising:

a generally U-shaped molded body defined in an x-direction, a y-direction perpendicular to the x-direction, and a z-direction perpendicular to both the x-direction and the y-direction, the body being bisected in part by an x-y plane;

a lower curved portion of the body extending generally in the x-direction within the x-y plane and being bisected by the x-y plane;

a first upper side portion of the body extending from a first, end of the lower curved portion in both the y-direction and the z-direction and fully crossing to a first side of the x-y plane; and a second upper side portion of the body extending from a second, opposite end of the lower curved portion in both the y-direction and the z-direction and fully crossing to a second, opposite side of the x-y plane.

19. The bra of claim 18, wherein the body has a cross-sectional shape that continuously varies along a length of the body.

20. The bra of claim 18, further comprising a first support component attached to a lower edge of a left bra cup and a second support component attached to a lower edge of a right bra cup, wherein the first support component is a mirror image of the second support component.

* * * * *

UNITED STATES PATENT AND TRADEMARK OFFICE

CERTIFICATE OF CORRECTION

PATENT NO. : 9,198,468 B2
APPLICATION NO. : 13/767377
DATED : December 1, 2015
INVENTOR(S) : Carolyn McNeeley et al.

It is certified that error appears in the above-identified patent and that said Letters Patent is hereby corrected as shown below:

In the Claims

In claim 1, at column 8, line 44, delete the "," after the word "crossing"

In claim 1, at column 8, line 49, the ";" after the word "second" should be a --,--

In claim 2, at column 8, line 51, the word "tint" should read --first--

In claim 8, at column 9, line 10, delete the "," after the word "defined"

In claim 11, at column 9, line 21, delete the "," after the word "having"

In claim 11, at column 9, line 23, delete the "," after the word "having"

In claim 11, at column 9, line 24, delete the "," after the word "portion"

In claim 11, at column 9, line 33, the word "both" should read --body--

In claim 12, at column 9, line 40, the word "hod" should read --body--

In claim 17, at column 10, line 15, the word "carved" should read --curved--

In claim 18, at column 10, line 28, delete the "," after the second occurrence of the word "first"

Signed and Sealed this
Twenty-sixth Day of April, 2016

Michelle K. Lee

Michelle K. Lee
*Director of the United States Patent and Trademark Office*